United States Patent [19]

Gibbon et al.

[11] Patent Number: 4,751,143

[45] Date of Patent: Jun. 14, 1988

[54] PROCESS FOR TREATING CHEMICALLY STABILIZED, ADHESIVE ACTIVATED POLYESTER MATERIAL, POLYESTER MATERIAL TREATED BY THE PROCESS AND AN IMPROVED FINISH COMPOSITION

[75] Inventors: John D. Gibbon, Charlotte; Norman S. Anderson, Matthews, both of N.C.

[73] Assignee: Celanese Corporation, New York, N.Y.

[21] Appl. No.: 652,403

[22] Filed: Sep. 20, 1984

[51] Int. Cl.[4] ..... B32B 27/36

[52] U.S. Cl. ..... 428/395; 8/115.6; 8/DIG. 4; 57/250; 57/257; 156/110.1; 156/330; 252/8.8; 252/8.9; 264/210.8; 523/402; 523/457; 523/459; 523/461; 427/175; 427/176; 427/386; 427/389.9; 428/413

[58] Field of Search ..... 427/175, 176, 386, 389.9; 428/395, 413; 252/8.8, 8.9; 264/210.8; 156/110.1, 330; 57/257 R, 250; 8/115.6, DIG. 4; 523/402

[56] References Cited

U.S. PATENT DOCUMENTS

| | | | |
|---|---|---|---|
| 3,793,425 | 2/1974 | Arrowsmith | 264/136 |
| 3,940,544 | 2/1976 | Marshall et al. | 428/378 |
| 4,054,634 | 10/1977 | Marshall et al. | 264/210 F |
| 4,210,700 | 7/1980 | Marshall et al. | 428/395 |
| 4,348,517 | 9/1982 | Chakrauarti | 427/387 X |
| 4,397,985 | 8/1983 | Marshall et al. | 524/837 |

FOREIGN PATENT DOCUMENTS 0043410 1/1982 European Pat. Off. .

*Primary Examiner*—Theodore E. Pertilla
*Attorney, Agent, or Firm*—Forrest D. Stine

[57] ABSTRACT

The aging period for chemically stabilized, adhesive activated polyester material can be reduced by contacting the material before it is substantially drawn or stretched with a composition containing a defined epoxide compound catalyzed with ions of at least one of potassium, cesium, rubidium or ammonium at a pH of between about 7.5 to about 13.0. The composition preferably also contains chloride, bromide or iodide ions which stabilizes the pH and/or an amine which improves adhesion to rubber.

29 Claims, No Drawings

PROCESS FOR TREATING CHEMICALLY STABILIZED, ADHESIVE ACTIVATED POLYESTER MATERIAL, POLYESTER MATERIAL TREATED BY THE PROCESS AND AN IMPROVED FINISH COMPOSITION

BACKGROUND OF THE INVENTION

1. Field of the Invention

The present invention relates to a process for treating chemically stabilized, adhesive activated polyester material and to polyester material which has been treated by the process. The present invention also relates to an improved finish composition by which treatment is achieved.

2. Description of the Prior Art

It is well known in the art to treat polyester material with various formulations in an attempt to improve the adhesion of the material to substances such as rubber. For example, in U.S Pat. No. 4,210,700, multifilament polyethylene terephthalate yarn is treated with a two-part fiber finish composition. The first part is applied to the yarn after it is spun and the second part is applied as an overfinish subsequent to drawing. The second part is an oil-in-water emulsion containing defined amounts of coconut oil, polyoxyethylene hydrogenated castor oil and phosphated polyoxyethylated tridecyl alcohol neutralized with potassium hydroxide.

In U.S. Pat. No. 4,054,634, multifilament polyethylene terephthalate yarn is also treated with a two part finish, one part of which is applied after spinning and one part of which is applied after drawing. The first part contains a defined polyoxyethylated-polyoxypropylated monoether whereas the second part contains the monoether in combination with a defined epoxy ether silane and a sufficient amount of a water soluble alkaline catalyst, such as sodium hydroxide, potassium hydroxide, sodium carbonate, potassium carbonate, sodium acetate, potassium acetate and organic amine compounds, to raise the pH to 8–10. Also see U.S. Pat. No. 4,348,517 wherein the same epoxy ether silane is combined with the triglycidyl ether of glycerol and a defined diglycidyl ether and is used as a fiber finish for polyester yarn.

U.S. Pat. No. 3,793,425 also describes a process for improving the adhesion of polyester material to rubber. In the process, undrawn polyester yarn is coated with a composition containing an epoxy resin which is preferably buffered with an alkaline agent, such as sodium carbonate, lithium carbonate, potassium carbonate or ammonium hydroxide. The use of epoxy resins with alkaline catalysts to improve the adhesion of polyester to rubber is further disclosed in U.S. Pat. Nos. 3,423,230 and 3,464,878.

To improve chemical stability, polyester material with lower carboxyl end groups is employed. However, when such polyester material is bonded to rubber, significant adhesion problems can occur. In an attempt to alleviate this problem, U.S. Pat. No. 3,940,544 describes the use of a finish for polyester yarn comprising a defined polyalkylene glycol and a defined triol which is preferably prepared by reacting tris(2-hydroxyethyl) isocyanurate with propylene oxide and/or ethylene oxide.

In U.S. Pat. No. 4,397,985, regular or low carboxyl polyester yarn is treated to improve rubber adhesion by using a finish or overfinish composition which includes gamma-glycidoxypropyltrimethoxysilane and a catalyst therefor selected from the group consisting of urea and a cobalt, stannous, iron, nickel, zinc, manganese or chromium salt of 2-ethylhexoic acid or lauric acid in a carrier which is miscible in water.

Regular or low carboxyl polyester yarn is also treated to improve rubber adhesion in published European patent application No. 0043410. In the disclosed process, the yarn is spun and drawn, the drawn yarn is exposed to ultraviolet radiation and the exposed drawn yarn is treated with a finish composition comprising water and a defined silane.

OBJECTS OF THE INVENTION

It is a general object of the present invention to solve or substantially alleviate the problems of the prior art associated with chemically stabilized polyester.

It is a more specific object of the present invention to reduce the ageing period for chemically stabilized, adhesive activated polyester material.

It is a further object of the present invention to improve the adhesion of chemically stabilized polyester material to substances such as rubber.

It is a still further object of the present invention to reduce the need for extensive storage facilities and to improve the flexibility of production operations of chemically stabilized, adhesive activated polyester material with respect to market demand.

These and other objects of the invention as well as the scope, nature and utilization of the present invention will be apparent from the following description and the appended claims.

SUMMARY OF THE INVENTION

In a first aspect, the present invention provides a process for treating chemically stabilized, adhesive activated polyester material. The process comprises:

(a) contacting chemically stabilized polyester material with a composition comprising:

(i) from about 5 to about 50% by dry weight of an epoxy compound having greater than 1 epoxy group and an equivalent weight of less than about 500 per epoxide group, (ii) at least about 0.004 equivalents per equivalent of epoxide of a catalyst which is ions selected from the group consisting of potassium, rubidium, cesium, ammonium and mixtures thereof wherein said composition is buffered to obtain a pH within the range of from about 7.5 to about 13.0; and (b) drawing the polyester material wherein the drawn polyester material has a carboxyl end group level of less than about 18 microequivalents per gram.

In further aspects, the present invention provides polyester material prepared by the process, tire cord containing the treated polyester material and a finish composition which may be used in the process.

DETAILED DESCRIPTION OF THE INVENTION

As mentioned hereinabove, one aspect of the present invention relates to a process for chemically treating chemically stabilized, adhesive activated polyester material.

The polyester employed in the present invention is any polymeric linear ester which may be obtained by reacting one or more glycols of the series $HO(CH_2)_nOH$ wherein n ranges from 2 to 6 with one or more dicarboxylic acids such as naphthalene dicarboxylic acid, 4,4′ diphenyl dicarboxylic acid or, preferably, terephthalic acid. Of course, the polyester may also be prepared by alternate techniques such as polymerization of the monoester. Additionally, the polyester may be reacted or blended with compatible compounds or polymers which do not substantially adversely affect the characteristics of the polyester. For example, compounds yielding non-ester linkages can be added into the reaction mixture for the polyester or formed polymers, pigments, fillers, anti-oxidants, etc. can be blended with the polyester. Preferably, the polyester is polyethylene terephthalate which has an intrinsic viscosity of at least 0.60, preferably 0.65 to 1.00 and most preferably 0.85 to 0.5 deciliters per gram.

The material into which the polyester is formed can be any size and configuration amenable to processing which will undergo adhesive activation. The material can therefore be filaments, yarns, cords and fabrics. Preferably, the material is filaments or yarn that is melt spun and quenched, particularly those intended for adhesion to rubber as in the production of tires. An especially preferred polyester material is multifilament polyethylene terephthalate yarn which is highly crystalline and highly stressed. Such yarn has often required extensive aging periods of 90 days or more to ensure a consistently high level of adhesive activation.

The preparation of such high crystalline and highly stressed yarn is, for example, set forth in U.S. Pat. No. 4,414,169, the content of which is incorporated by reference. An alternate process for preparing multifilament polyethylene terephthalate yarn is set forth in U.S. Pat. No. 4,195,052, the content of which is also incorporated by reference.

Highly crystalline, highly stressed yarn of the type particularly useful in the present invention is evidenced by the following characteristics:

(a) a crystallinity of from about 45 to about 55 percent, (b) a crystalline orientation function of at least about 0.97, (c) an amorphous orientation function of from about 0.37 to about 0.60, (d) a TMA shrinkage of less than about 8.5 percent in air at 175° C., (e) an initial modulus of at least about 100 grams per denier at 25° C. (e.g. from about 110 to about 150 grams per denier), (f) a tenacity of at least about 7.0 grams per denier at 25° C. (e.g. from about 7.0 to about 10 grams per denier) and preferably at least about 7.5 grams per denier at 25° C., and (g) a work loss of from about 0.004 to about 0.04, preferably from about 0.004 to about 0.035 and most preferably from about 0.004 to about 0.030 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

The fraction crystalline, X, is determined by conventional density measurements. The crystalline orientation function $f_c$ is calculated from the average orientation angle, $\theta$, as determined by wide angle x-ray diffraction. Photographs of the diffraction pattern are analyzed for the average angular breadth of the (010) and (100) diffraction arcs to obtain the average orientation angle, $\theta$. The crvstalline orientation function, $f_c$ is then calculated from the following equation:

$$f_c = \tfrac{1}{2}(3\cos^2\theta - 1).$$

The product characterization parameters referred to herein other than crystallinity, crystalline orientation function, and amorphous orientation function are determined by testing the resulting multifilament yarns consisting of substantially parallel filaments. The entire multifilament yarn is tested, or alternatively, a yarn consisting of a large number of filaments is divided into a representative multifilament bundle of a lesser number of filaments which is tested to indicate the corresponding properties of the entire larger bundle. The number of filaments present in the multifilament yarn bundle undergoing testing is 20. The filaments present in the yarn during testing are untwisted.

The tenacity values and initial modulus values of the yarn are determined in accordance with ASTM D2256 using an Instron tensile tester (Model TM) using a 3½ inch gauge length and a strain rate of 60 percent per minute.

TMA shrinkage values are determined through the utilization of a DuPont Thermomechanical Analyzer (Model 941) operated under zero applied load and at a 10° C./min. heating rate with the gauge length held constant at 0.5 inch.

As described in the article by Edward J. Powers entitled, "A Technique for Evaluating the Hysteresis Properties of Tire Cords", by Edward J. Powers appearing in Rubber Chem. and Technol. 47, No. 5, December, 1974, pages 1053–1065, the contents of which are inoperated by reference, the work loss test which yields the identified work loss values is dynamically conducted and simulates a stress cycle encountered in a rubber vehicle tire during use wherein the polyester fibers serve as fibrous reinforcement. The method of cycling was selected on the basis of results published by Patterson (Rubber Chem. Technol. 42, 1969, page 812) wherein peak loads were reported to be imposed on cords by tire air pressure and unloading was reported to occur in cords going through a tire foot print. For slow speed test comparisons of yarns, a peak stress of 0.6 gram per denier and minimum stress of 0.05 gram per denier were selected as being within the realm of values encountered in tires. A test temperature of 150° C. was selected. This would be a severe operating tire temperature, but one that is representative of the high temperature work loss behavior of tire cords. Identical lengths of yarn (10 inches) were consistently tested and work loss data are normalized to that of a 1000 total denier yarn. Since denier is a measure of mass per unit length, the product of length and denier ascribes a specific mass of material which is a suitable normalizing factor for comparing data.

Generally stated the slow speed test procedure employed allows one to control the maximum and minimum loads and to measure work. A chart records load (i.e. force or stress on the yarn) versus time with the chart speed being synchronized with the cross head speed of the tensile test utilized to carry out the test. Time can accordingly be converted to the displacement of the yarn undergoing testing. By measuring the area under the force-displacement curve of the tensile tester chart, the work done on the yarn to produce the deformation results. To obtain work loss, the area under the unloading (relaxation) curve is subtracted from the area under the loading (stretching) curve. If the unloading curve is rotated 180° about a line drawn vertically from the intercept of the loading and unloading curves, a typical hysteresis loop results. Work loss is the force-displacement integral within the hvsteresis loop. These loops would be generated directly if the tensile tester chart direction was reversed synchronously with the loading and unloading directions of the tensile tester cross head. However, this is not convenient, in practice, and the area within the hysteresis loop may be determined arithmetically.

As mentioned above, the polyester material used in the present invention is chemically stabilized. Under typical preparation conditions, polyester, such as polyethylene terephthalate, has a level of carboxyl end groups ranging from about 30 to about 40 microequivalents per gram. To obtain chemical stabilization of the polyester, a compound such as ethylene carbonate, phenyl glycidyl ether, or preferably ethylene oxide, is incorporated into the source from which the polyester material is to be formed. For example, ethylene oxide can be added to a polyester melt which is maintained at a pressure of from about 500 to about 5000 psig in accordance with the disclosures of U.S. Pat. Nos. 4,016,142 and 4,442,058, the contents of which are incorporated by reference.

The stabilizing compound is present in an amount sufficient to lower the level of carboxyl end groups in the drawn polyester material to less than about 18, preferably less than about 15 and most preferably about 12 or less microequivalents per gram as determined by dissolving 2 grams of the polyester material (with any finish previously removed) in 50 ml of a 70/30 (w/w) mixture of 0-cresol/chloroform such as available from Reagents, Inc. and titrating against a 0.05 N solution of potassium hydroxide. Using an Mettler Dl 40 Memotitrator, the endpoint can be determined potentiometrically. Of course, other reliable techniques can likewise be used to determine the level of carboxyl end groups in the drawn polyester.

In certain instances, the polyester material may be prepared under such conditions as will enable chemical stabilization to occur without the need for a stabilizing compound and the present invention can likewise be applied to such material as long as the stated level of carboxyl end groups is obtained in the drawn material.

When chemically stabilized polyester material having a low level of carboxyl end groups is subsequently adhesive activated by reaction with an epoxy compound in conjunction with a sodium carbonate catalyst and alkaline agent, it has been found that an extended period of time is often necessary in order to develop the full level of adhesion. The ageing period (i.e., the time between preparation of the treated material and application of the adhesive to obtain acceptable adhesive levels) is at least 10 days and may be much longer. For example, as indicated above, one type of a high stress, high strength polyethylene terephthalate yarn having a carboxyl end group content of from about 8 to about 12 microequivalents per gram and characteristics defined above has been found to require an ageing period of as long as 3 months before the adhesive levels are fully developed.

The ageing period necessary for fully developing the adhesive levels of chemically stabilized, adhesive activated polyester material can cause significant problems. Specifically, it can require devoting substantial capital to inventory in anticipation of market demand. Additionally, it requires substantial ageing and storage areas. Of course, if the ageing period is prematurely terminated, the end users can be presented with a product that may not meet an expected standard or may have varying levels of adhesion.

The problems associated with the ageing period have been alleviated to a large extent by the present invention. In particular, by selecting a defined catalyst which is used in conjunction with an epoxy compound, adhesive activation is obtained in a shorter period than that which was formerly necessary to obtain the same level of adhesion when sodium carbonate was used as the catalyst.

The epoxy compound used in the present invention has greater than 1 epoxy group, preferably, at least 2 epoxy groups and an equivalent weight of less than about 500 per epoxide group, preferably less than about 200 per epoxide group. For example, if the epoxy compound has two epoxy groups, then it has a molecular weight of less than about 1,000. Exemplary epoxy compounds are glycidyl ethers of polyhydroxy compounds such as glycerol polyglycidyl ether, polyglycerol polyglycidyl ether, Bisphenol A diglycidyl ether, sorbitol polyglycidyl ether, glycidyl esters of polycarboxyl acids or glycidyl ether/ester compounds. Other exemplary epoxy compounds may be found in aforementioned U.S. Pat. No. 3,793,425, the contents of which are incorporated by reference. Preferably, the epoxy compound is a glycidyl ether of a polyalcohol and most preferably, it is glycerol polyglycidyl ether.

In order to develop any adhesive activation, the epoxy compound must be buffered with an alkaline agent. The alkaline agent may be any material or combination of materials which raises the pH of the composition containing the epoxy compound to within the range of from about 7.5 to about 13.0, preferably from about 8.5 to about 12.5 and which does not substantially adversely effect the advantages obtained by the invention. Illustrative alkaline agents are sodium carbonate, sodium bicarbonate, sodium hydroxide, lithium carbonate, lithium bicarbonate, lithium hydroxide, organic alkaline amines, such as ethoxylated fatty amines, and piperazine. Of course, compatible mixtures of alkaline agents may likewise be used. Preferably, halogen ions selected from the group consisting of chloride, bromide and iodide ions and mixtures thereof are also present in an amount ranging from about 0.01 to about 1.0, preferably from about 0.05 to 0.15 equivalents halide per equivalent of epoxide in order to obtain a relatively stable pH.

In order to obtain the reduction in the ageing period, a catalyst which is ions of at least one member of the group consisting of potassium, rubidium, cesium and ammonium (either unsubstituted or substituted) must be present with the alkaline-buffered, epoxy compound. When ammonium is employed as the catalyst, it should be employed in a form or under conditions wherein volatilization of the compound (e.g., as ammonia) is substantially avoided. This may be achieved, for example, by employing a quat ammonium compound wherein each of the substituents has from about 1 to about 20 carbon atoms.

The catalyst is typically added as a compound capable of releasing ions using any suitable counter anion. Exemplary anions are chloride, bromide, iodide, hydroxide, carbonate, bicarbonate and borate. Preferably, the catalyst is present as an alkaline compound and/or as a halide salt whereby it can function in whole or in part as the alkaline agent and/or as the source of the halogen ions. The preferred catalyst contains potassium ions, preferably added in the form of potassium carbonate, bicarbonate or hydroxide and especially combined with potassium chloride.

In accordance with a preferred embodiment of the present invention, the polyester material is treated with the epoxy compound substantially before it is drawn or stretched. In other words, the epoxy compound is not applied as a too coat composition. While the polyester material may be treated sequentially with a standard finish composition and a separate composition containing the epoxy compound, the alkaline agent and the catalyst, the polyester material is typically treated with a composition which includes the epoxy compound, the alkaline agent, the catalyst and conventional finish ingredients such as a lubricant, an emulsifier, etc. The epoxy compound is generally present in the composition in an amount ranging from about 1 to about 50% by dry weight, preferably from about 5 to about 40% by dry weight. As used herein, the term "dry weight" excludes the presence of water in the determination of the amount of the constituent in the composition.

The alkaline agent is present in an amount sufficient to raise the pH to the desired level with the range of from about ( 7.5 to about 13.0, preferably from about 8.5 to about 12.5. As pointed out above, it is preferred that halogen ions of the group of chloride, bromide and iodide ions, preferably chloride ions, be present so as to maintain a relatively stable pH. Stabilization occurs via the interaction of the halogen ions with epoxy groups which results in the release of hydroxyl groups. Since this interaction reaches equilibrium, a relatively constant pH is obtained.

The catalyst is present in an amount of at least about 0.004 equivalents per equivalent of epoxide, preferably from about 0.01 to about 0.40 and most preferably from about 0.03 to about 0.10 equivalents per equivalent of epoxide. Since the results for the catalyst are believed to be based on the defined cations and since any suitable anion can be employed, the amount of catalyst is determined on the basis of the amount of cation. For example, if 0.1 equivalents of potassium chloride is employed as the catalyst source for an epoxy compound of equivalent weight 190, then the weight of potassium chloride used would be 7.46 grams per 190 grams of epoxide.

In a preferred aspect of the present invention, the catalyst is combined with from about 2 to about 60%, preferably from about 5 to about 50% by weight of the epoxide compound of an amine as a buffering agent. Especially useful are tertiary amines which are water soluble and have a molecular weight greater than about 250 so that they substantially survive yarn processing temperatures. Such amines are typically stable at 250° C. and atmospheric pressure. Exemplary amines are ethoxylated fatty amines with from about 5 to about 30 moles ethylene oxide added per amine group with the preferably amine being polyoxyethylene (20) tallow amine. The amine functions with the catalyst to yield levels of adhesion which are greater than those obtained using conventional systems and which may be greater than either an equivalent amount of the catalyst or amine alone.

In the event that the composition is to serve as a lubricating finish composition, an effective amount for lubrication, such as from about 20 to about 50% bv dry weight, of a conventional lubricant, such as natural oils, (e.g., cottonseed oil, coconut oil, etc.), mineral oil or synthetic oil (e.g., silicone oil or ethoxylated polysiloxanes or ethylene oxide/propylene oxide copolymers) is present. Such a finish composition is typically applied as an oil in water emulsion comprised of from about 5 to about 25, preferably from about 12 to about 16% by weight of solids (i.e., the non-aqueous constituents). Of course, other conventional constituents, such as emulsifiers, biocides, tints, antifoams, antistatic agents, antioxidants, etc., may also be present in known amounts in the composition.

The composition is applied to the polyester material by known techniques such as via a kiss roll, spray, foam, metered applicator, etc. and results in an amount of the composition on the polyester material ranging from about 0.1 to about 0.8%, preferably from about 0.3 to about 0.5% based on the weight of the yarn. Preferably, the composition is applied to the polyester material at a temperature in the range of from about 10 to about 40° C. and more preferably from about 20 to about 25° C.

After the composition is applied, the polyester material is drawn or stretched to obtain the desired degree of orientation of the polyester material. A total draw of from about 5.0:1.0 to about 6.5:1.0, preferably from about 5.7:1.0 to about 6.3:1.0 in the low birefringence process and from about 1.5:1.0 to about 2.8:1.0, preferably from about 2.0:1.0 to about 2.6:1.0 in the high birefringence (i.e., high stress) process is typically conducted in one or more drawing stages using known equipment such as a pair of skewed draw rolls.

The draw temperature is likewise selected to yield the desired result. For example, in a high birefringence two stage draw technique, the first draw step can be conducted at a temperature below the glass transition temperature of the polyester (e.g., room temperature) as set forth in aforementioned U.S. Pat. No. 4,414,169. Likewise, the second draw step can also be conducted at a temperature below the glass transition temperature of the polyester (e.g., at room temperature).

After drawing, the polyester material may be subjected to a relaxing step of from about 0 to about 4% and/or ehat setting at from about 190 to about 240° C. and then collected. In the absence of the catalyst of the present invention, the thusly prepared chemically stabilized, adhesive activated polyester material is aged for from about 10 to about 90 days depending on the specific type of polyester material in order for the necessary level of adhesion to develop fully. On the other hand, by following the present invention, the ageing period is significantly less than when using a equivalnet amount of sodium as the catalyst. In particular, a reduction of from about 10 to about 100% in the length of the ageing period can be obtained to obtain the same level of adhesion.

After activation of the chemically stabilized polyester material, an adhesive which is typically a phenolic-aldehyde-latex adhesive is applied to the material. The term "phenolic-aldehyde-latex adhesive" is meant to include phenolic-aldehyde-latex containing compositions which are known and used in the textile and rubber industries for the bonding of polyester fibers to rubber. The phenolic-aldehvde component (e.g., a resole) can be any condensation product of an aldehyde with a phenol which can be heat-cured to form an infusible material. A typical phenolic-aldehyde-latex adhesiye composition is a formulation containing resorcinol-formaldehyde resin and a rubber latex such as styrene-butadiene vinyl pyridine latex (e.g., an RFL adhesive). The preparation of such adhesives is well known in the art and will not be discussed further herein. Of course, other suitable adhesives can be used in lieu of or in addition to the adhesives discussed above.

The phenolic-aldehyde-latex adhesive is generally applied in a quantity of from about 2 to about 20 weight percent (solids retention), based on the weight of the polyester material. The phenolic-aldehyde-latex adhesive is preferably applied after the filament or yarn has been spun into cord or woven into fabric. Preferably, the adhesive-coated material is subjected to a drying and curing treatment, both to eliminate the moisture in the coating and to complete the condensation of the phenolic-aldehyde component. The drying and curing operation is conveniently conducted in the presence of hot circulating air at a temperature of from about 120° to about 260° C.

The chemically stabilized, adhesive activated polyester material onto which the adhesive has been applied may then be used as reinforcing materials in the preparation of reinforced rubber-based materials such as pneumatic tires, conveyor belts, hoses, transmission belts, raincoats, and the like.

The following Examples are given as illustrations of the invention. It should be understood, however, that the invention is not limited to the specific details set forth in the Examples.

Preparation of Chemically Stabilized Polyester Material

Polyethylene terephthalate (PET) having an intrinsic viscosity in the range of 0.85 to 0.94 deciliters/gram is melted and ethylene oxide is added to the melt in an amount sufficient, to yield a carboxyl end group level of about 12 microequivalents per gram. The melt is spun at a temperature in the range of 280 to 320° C. through a spinneret having 480 holes at a spinning speed in the range of 750 to 1250 meters per minute. The first stage draw ratio is in the range of 1.4:1.0 to 2.0:1.0 and is conducted at less than 70° C. and the second stage draw ratio is selected such that the overall draw ratio is in the range of 1.5:1.0 to 2.8:1.0 and is also conducted at less than 70° C. The PET yarn is heat set at about 220° C. and is then wound to obtain a slight relaxation. The thusly prepared yarn exhibits a 1000 denier.

PET yarn prepared in accordance with the above process is subjected to a two to the fourth power factorial experimental procedure and the total results are analyzed statistically in a manner known in the art. Specifically, the PET yarn is treated after spinning and before the first stage draw with a composition which is an oil in water emulsion containing either 10 or 15% by weight of solids including 60 or 64.6% by dry weight of lubricant and emulsifier (which are ethoxylated compounds), either 35.4 or 40% by dry weight of glycerol polyglycidyl ether, sodium carbonate or potassium carbonate in an amount sufficient to raise the pH to 9–10 and, in some instances, potassium or sodium chloride is added at the level of 1.0 equivalent of chloride per 10 equivalents of epoxide and in these instances, the pH is adjusted to 9–10 with potassium or sodium hydroxide. The composition is applied by a metered applicator to obtain an amount of the composition on the yarn of 0.5% by dry weight. The, thusly treated yarn is aged for 6, 17 or 32 days and is twisted into 2-ply cords having 12×12 twists per inch.

The cord is then treated using a dip pick-up of 4.0% with a resorcinol-formaldehyde-latex (RFL) adhesive composition having the following ingredients:

| Ingredients | Parts By Wt. |
|---|---|
| NaOH (50%) | 2.6 |
| Resorcinol | 16.6 |
| Formaldehyde (37%) | 17.2 |
| Terpolymer rubber latex of styrene/butadiene-1,2/vinylpyridine 15/70/15 (41%) | 245 |
| Water | 331 |

The adhesive composition is prepared by adding 16.6 parts of the resorcinol to 331 parts of water followed by the addition of 17.2 parts of formaldehyde (37%) and 2.6 parts of 50% NaOH. The resulting mixture is aged for one hour and then 245 parts of the terpolymer rubber latex are added. The resulting mixture is then aged for a period of 72 hours.

After coating with the RFL, the coated cord is subjected to a conventional curing using a Litzler Computreator at standard conditions for tire cord.

The treated cord is placed on a fabric backed rubber piece by winding on a rotating drum. The cord is placed with as tight as possible an end count. The fabric is cut into two 3 "×3" squares and these squares are placed together, treated cord to treated cord, with a rubber layer 0.040" thick in between. The sample is then vulcanized at 320° F. for 20 minutes at 50 psi and the vulcanized sample is cut into three 1" strips.

One 1" strip is placed in an environmental chamber at 250° F. for 15 minutes and then the fabric plies are pulled apart at 250° F. on an Instron tensile tester.

To test adhesion under more severe conditions, a further 1" strip is placed in an autoclave and subjected to 12 psi steam for two hours, allowed to cool, and the fabric plies are pulled apart at ambient conditions.

Adhesion is set forth in Table I (250° F. Peel Test) and Table II (Two Hour Steam Peel Test) as pounds/inch and visual rating. Pounds/inch is the average force required to pull the strip apart and the visual rating is on a 1 to 5 scale where 1.0 is total failure at the cord surface and 5.0 is cohesive failure in the rubber compound.

TABLE I

| Run | Emulsion | Epoxy | Catalyst | Halogen | Carboxyl End Groups (microequiv./g) | Adhesion Level After Aging (In Days) 6 | 17 | 32 |
|---|---|---|---|---|---|---|---|---|
| 1 | – | – | Na | – | 10 | 37/3.2 | 40/3.8 | 42/4.7 |
| 2 | + | – | Na | – | 14 | 33/3.5 | 34/3.5 | 43/4.7 |
| 3 | – | + | Na | – | 11 | 35/3.5 | 33/3.3 | 37/4.0 |
| 4 | + | + | Na | – | 14 | 32/3.3 | 32/3.0 | 42/4.5 |
| 5 | – | – | K | – | 6 | 40/4.3 | 38/3.9 | 42/4.8 |
| 6 | + | – | K | – | 11 | 40/4.1 | 38/4.0 | 42/4.8 |
| 7 | – | + | K | – | 11 | 42/4.6 | 40/4.7 | 45/4.9 |
| 8 | + | + | K | – | 24 | 40/4.3 | 38/4.9 | 42/4.7 |
| 9 | – | – | Na | + | 8 | 39/3.6 | 40/3.8 | 42/4.7 |
| 10 | + | – | Na | + | 6 | 38/3.6 | 34/3.5 | 46/4.6 |
| 11 | – | + | Na | + | 11 | 37/3.3 | 37/3.5 | 48/4.8 |
| 12 | + | + | Na | + | 25 | 38/3.8 | 43/4.9 | 46/4.8 |

TABLE I-continued

| Run | Emulsion | Epoxy | Catalyst | Halogen | Carboxyl End Groups (microequiv./g) | Adhesion Level After Aging (In Days) 6 | 17 | 32 |
|---|---|---|---|---|---|---|---|---|
| 13 | − | − | K | + | 12 | 42/4.0 | 40/4.6 | 46/4.8 |
| 14 | + | − | K | + | 12 | 38/3.8 | 40/4.7 | 43/4.8 |
| 15 | − | + | K | + | 14 | 37/3.8 | 38/4.2 | 45/4.8 |
| 16 | + | + | K | + | 12 | 44/4.8 | 38/4.0 | 42/4.8 |

In the foregoing Table, Runs 1–4 and 8–12 are comparative and the remaining runs illustrate various aspects of the present invention. Additionally, the following definitions for the "+" and "−" signs are used:

| | + | − |
|---|---|---|
| Emulsion | 15% | 10% |
| Epoxy | 40% | 35.4% |
| Halogen | $Cl^-$ | None |

TABLE II

| Run | Emulsion | Epoxy | Catalyst | Halogen | Carboxyl End Groups (microquiv./g) | Adhesion Level After Aging (In Days) 6 | 17 | 32 |
|---|---|---|---|---|---|---|---|---|
| 17 | − | − | Na | − | 10 | 28/1.9 | 36/2.0 | 50/2.8 |
| 18 | + | − | Na | − | 14 | 21/1.5 | 30/1.5 | 31/2.0 |
| 19 | − | + | Na | − | 11 | 25/1.6 | 29/1.5 | 32/1.9 |
| 20 | + | + | Na | − | 14 | 20/1.5 | 26/1.5 | 35/1.9 |
| 21 | − | − | K | − | 6 | 38/2.3 | 24/1.4 | 50/3.0 |
| 22 | + | | K | − | 11 | 22/1.5 | 36/1.8 | 34/2.0 |
| 23 | − | + | K | − | 11 | 33/1.9 | 40/2.1 | 50/2.8 |
| 24 | + | + | K | − | 24 | 44/2.5 | 54/3.0 | 62/3.5 |
| 25 | − | − | Na | + | 8 | 21/1.5 | 30/1.8 | 25/1.6 |
| 26 | + | − | Na | + | 6 | 23/1.6 | 28/1.5 | 35/2.0 |
| 27 | − | + | Na | + | 11 | 25/1.7 | 33/1.8 | 32/1.8 |
| 28 | + | + | Na | + | 25 | 30/1.8 | 50/2.8 | 51/2.9 |
| 29 | − | − | K | + | 12 | 28/1.7 | 45/2.4 | 53/3.1 |
| 30 | + | − | K | + | 12 | 26/1.8 | 40/2.1 | 41/2.4 |
| 31 | − | + | K | + | 14 | 37/2.6 | 42/2.6 | 43/2.6 |
| 32 | + | + | K | + | 12 | 35/2.2 | 44/2.4 | 51/3.1 |

In the foregoing Table, Runs 17–20 and 24–28 are comparative and the remaining runs illustrate various aspects of the previous invention. Additionally, the following definitions of the "+" and "−" signs are used:

| | + | − |
|---|---|---|
| Emulsion | 15% | 10% |
| Epoxy | 40% | 35.4% |
| Halogen | $Cl^-$ | None |

Although the invention has been described with preferred embodiments, it is to be understood that variations and modifications may be employed as will be apparent to those skilled in the art. Such variations and modifications are to be considered within the purview and scope of the claims appended hereto.

We claim:

1. A process for treating chemically stabilized, adhesive activated polyester material obtained by reacting one or more glycols of the series $HO(CH_2)_nOH$ wherein n ranges from 2 to 6 with one or more dicarboxylic acids comprising:

(a) contacting chemically stabilized polyester material with a composition comprising:

(i) from about 1 to about 50% by dry weight of an epoxy compound possessing a plurality of 1,2-epoxy groups and an equivalent weight of less than about 500 per epoxide group, (ii) a compound capable of releasing at least about 0.004 equivalents per equivalent of epoxide of a catalyst which is ions selected from the group consisting of potassium, rubidium, cesium, ammonium and mixtures thereof and wherein said composition is buffered to obtain a pH within the range of from about 7.5 to about 13.0;

(b) drawing the polyester material wherein the drawn polyester material has a carboxyl end group level of less than about 18 microequivalents per gram.

2. The process of claim 1 wherein the composition further comprises a lubricant.

3. The process of claim 2 wherein the composition is an oil in water emulsion comprising from about 5 to about 25% by weight solids.

4. The process of claim 1 wherein the drawn polyester material is aged.

5. The process of claim 1 wherein the composition is applied such that the polyester material contains from about 0.1 to about 0.8% based on the weight of the yarn.

6. The process of claim 5 wherein the composition is contacted with the polyester material at a temperature in the range of from about 10 to about 40° C.

7. The process of claim 1 wherein the polyester material is selected from the group consisting of filaments and yarn.

8. The process of claim 7 wherein the polyester material comprises polyethylene terephthalate.

9. The process of claim 8 wherein the polyester material is characterized by:

(a) a crystallinity of from about 45 to about 55 percent, (b) a crystalline orientation function of at least about 0.97, (c) an amorphous orientation function of from about 0.37 to about 0.60, (d) a TMA shrinkage of less than about 8.5 percent in air at 175° C.,
(e) an initial modulus of at least about 100 grams per denier at 25° C.,
(f) a tenacity of at least about 7.5 grams per denier at 25° C., and
(g) a work loss of from about 0.004 to about 0.04 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

10. The process of claim 1 wherein the epoxy compound is selected from the group consisting of glycerol polyglycidyl ether, sorbitol polyglycidyl ether and mixtures thereof.

11. The process of claim 1 wherein the catalyst is added to the composition as an alkaline compound thereby serving as at least part of the buffer used to regulate the pH of the composition

12. The process of claim 11 wherein the catalyst is added to the composition as a catalyst compound selected from the group consisting of alkaline potassium compounds, alkalne ammonium compounds and mixtures thereof.

13. The process of claim 12 wherein the catalyst compound is selected from the group consisting of potassium carbonate, potassium bicarbonate and mixtures thereof.

14. The process of claim 1 wherein the composition further comprises an amine which is stable at 250° C. and atmospheric pressure.

15. The process of claim 14 wherein the amine is an ethoxylated fatty amine with from about 5 to about 30 moles ethylene oxide added per amine group.

16. The process of claim 1 wherein the drawn polyester material has a level of carboxyl end groups of less than about 15 microequivalents per gram.

17. The process of claim 1 wherein the composition has a pH in the range of from about 8.5 to about 12.5.

18. The process of claim 1 wherein the polyester material is multifilament polyethylene terephthalate yarn having a carboxyl end group level of less than about 15 microequivalents per gram.

19. The process of claim 18 wherein the polyester material is characterized by:
(a) a crystallinity of from about 45 to about 55 percent,
(b) a crystalline orientation function of at least about 0.97,
(c) an amorphous orientation function of from about 0.37 to about 0.60,
(d) a TMA shrinkage of less than about 8.5 percent in air at 175° C.,
(e) an initial modulus of at least about 100 grams per denier at 25° C.,
(f) a tenacity of at least about 7.5 grams per denier at 25° C.,
(g) a work loss of about 0.004 to about 0.04 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

20. Polyester material prepared by the process of claim 1.

21. Polyester material prepared by the process of claim 9.

22. A composition for treating chemically stabilized polyester material obtained by reacting one or more glycols of the series $HO(CH2)_n$ OH wherein n ranges from 2 to 6 with one or more dicarboxylic acids comprising:
(a) from about 1 to about 50% by dry weight of an epoxy compound possessing a plurality of 1,2-epoxy groups and an equivalent weight of less than about 500 per epoxide group, and
(b) a compound capable of releasing at least about 0.004 equivalents per equivalent of epoxide of a catalyst which is ions selected from the group consisting of potassium, rubidium, cesium, ammonium and mixtures thereof and wherein composition is buffered to a pH within the range of from about 7.5 to about 13.0.

23. Adhesive activated, chemically stabilized polyester material obtained by reacting one or more glycols of the series $HO(CH_2)_nOH$ wherein n ranges from 2 to 6 with one or more dicarboxylic acids and having a carboxyl end group level of less than about 18 microequivalents per gram and bearing the residue of a composition comprising:
(a) from about 1 to about 50% by dry weight of an epoxy compound possessing a plurality of 1,2-epoxy groups and a molecular weight of less than about 500 per epoxide group, and
(b) a compound capable of releasing at least about 0.004 equivalents per equivalent of epoxide of a catalyst which is ions selected from the group consisting of potassium, rubidium, cesium, ammonium and mixtures thereof and wherein the composition is buffered to a pH within the range of from about 7.5 to about 13.0.

24. The adhesive activated chemically stabilized polyester material of claim 23 wherein the polyester material is polyethylene terephthalate characterized by:
(a) a crystallinity of from about 45 to about 55 percent,
(b) a crystalline orientation function of at least about 0.97,
(c) an amorphous orientation function of from about 0.37 to about 0.60,
(d) a TMA shrinkage of less than about 8.5 percent in air at 175° C.,
(e) an initial modulus of at least about 100 grams per denier at 25° C.,
(f) a tenacity of at least about 7.5 grams per denier at 25° C.,
(g) a work loss of about 0.004 to about 0.04 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

25. The adhesive activated chemically stabilized polyester material of claim 24 wherein the carboxyl end group level is less than about 15 microequivalents per gram.

26. The adhesive activated chemically stabilized polyester material of claim 24 wherein the carboxyl end group level is 12 microequivalents per gram or less.

27. The process of claim 1 wherein said compound capable of releasing a catalyst which is ions selected from the group consisting of chlorides, bromides, iodides, hydroxides, carbonates, bicarbonates, and borates. .

28. The composition of claim 22 wherein said compound capable of releasing a catalyst which is ions ions selected from the group consisting of chlorides, bromides, iodides, hydroxides, carbonates, bicarbonates, and borates.

29. The polyester material of claim 23 wherein said compound capable of releasing a catalyst which is ions selected from the group consisting of chlorides, bromides, iodides, hyroxides, carbonates, bicarbonates, and borates.

* * * * *